United States Patent [19]

Lin

[11] Patent Number: 4,858,863

[45] Date of Patent: Aug. 22, 1989

[54] CHOPSTICK SEAT

[76] Inventor: Kuen-Ming Lin, No. 141, Po-Ai St., Chunan Chen, Miaoli Hsien, Taiwan

[21] Appl. No.: 308,831

[22] Filed: Feb. 9, 1989

[51] Int. Cl.[4] ..... A47G 21/14; A45D 19/04

[52] U.S. Cl. ..... 248/174; 211/70.1; 211/70.7; 248/37.3

[58] Field of Search ..... 248/37.3, 174; D7/73, D7/74; 211/70.7, 72, 73, 13, 60.1, 70.1

[56] References Cited

U.S. PATENT DOCUMENTS

| | | | |
|---|---|---|---|
| D. 292,861 | 11/1987 | Dorper | D7/73 |
| 1,717,456 | 6/1929 | Lasher | 211/73 X |
| 2,299,829 | 10/1942 | Feddersen | 248/450 |
| 2,651,927 | 9/1953 | Mullins | 248/37.3 X |
| 2,726,835 | 12/1955 | Hummew | 211/73 X |
| 3,013,668 | 12/1961 | Mennen | 211/73 X |
| 3,263,820 | 8/1966 | McFadden et al. | 211/70.1 X |

*Primary Examiner*—J. Franklin Foss
*Attorney, Agent, or Firm*—Ladas & Parry

[57] ABSTRACT

A one piece foldable sheet material such as paper is provided with folds to form a chopstick seat having a base portion, two converging side walls extending from the base portion and a V-shaped top wall. The top wall and the side walls are provided with two cut lines and the portion between two cut lines is formed into a concave face for supporting the tips of the chopsticks.

2 Claims, 4 Drawing Sheets

CHOPSTICK SEAT

BACKGROUND OF THE INVENTION

This invention relates to a chopstick seat, and particularly to a chopstick seat made of a foldable paper material or the like.

An object of the invention is to provide a novel chopstick seat to replace conventional ceramic chopstick seats which are too costly to be discarded once used and which are fragile and easily broken when handled and washed. The chopstick seat of the present invention can be produced easily and is inexpensive so that it can be discarded after use.

According to the present invention, a chopstick seat comprises a one piece folded member made of a foldable sheeting material and includes a portion folded so as to form a V-shaped concave top portion which has two longitudinal top edge folds and a longitudinal bottom edge fold between the top edge folds, two diverging side walls extending downward from the longitudinal top edge folds and having two longitudinal bottom edge folds, two horizontal base portions respectively extending from the bottom edge folds of the side walls and overlapping one another, and two spaced apart cut lines provided transversely relative to the top edge folds and extending in the top wall and downward into the side walls. The cut lines terminate in each side wall at two points which are higher than the level of the base portions and divide the top wall and the side walls into two spaced apart first portions and a second portion between the first portions. The second portion is further provided with two longitudinal folding lines, each extending between the terminating points in each side wall, and is folded therealong until both the top edge folds of the side walls approach one another and until the V-shaped concave top portion is collapsed and extends downward. The folded second portion forms an indented seat face which both lies between and is lower than the first portions. The terminating points are at substantially the same height from the horizontal base portions.

The exemplary preferred embodiment will be described in detail with reference to the accompanying drawings, in which:

DETAILED DESCRIPTION OF THE PREFERRED EMBODIMENT

Figure 1:
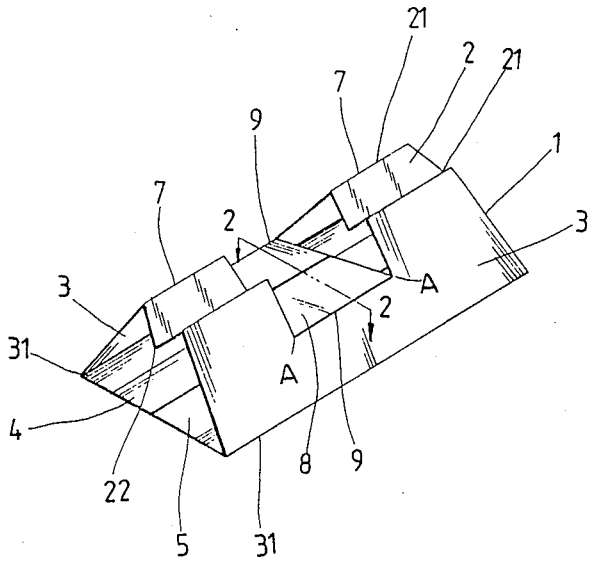
FIG. 1 is a perspective view of a chopstick seat according to the present invention.
Figure 2:
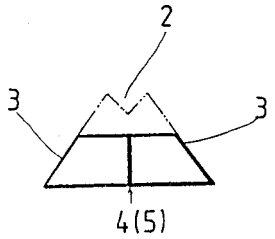
FIG. 2 is schematic sectional taken along line 2—2 of FIG. 1.
Figure 3:
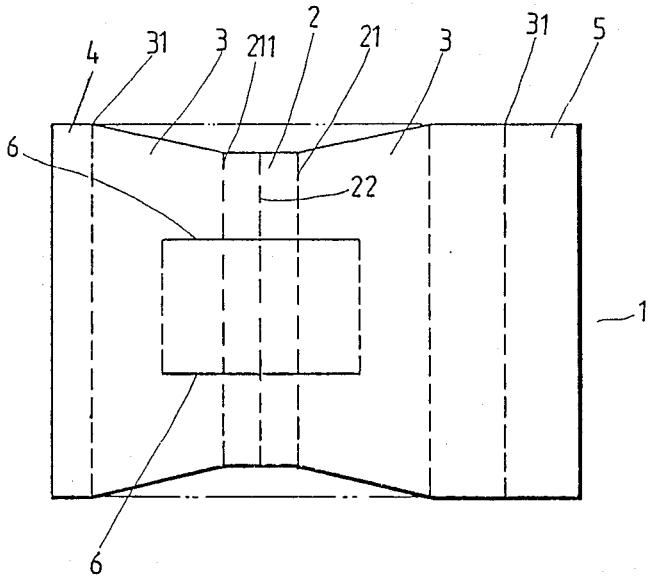
FIG. 3 is a foldable sheet to be made into the chopstick seat of the present invention.
Figure 4:
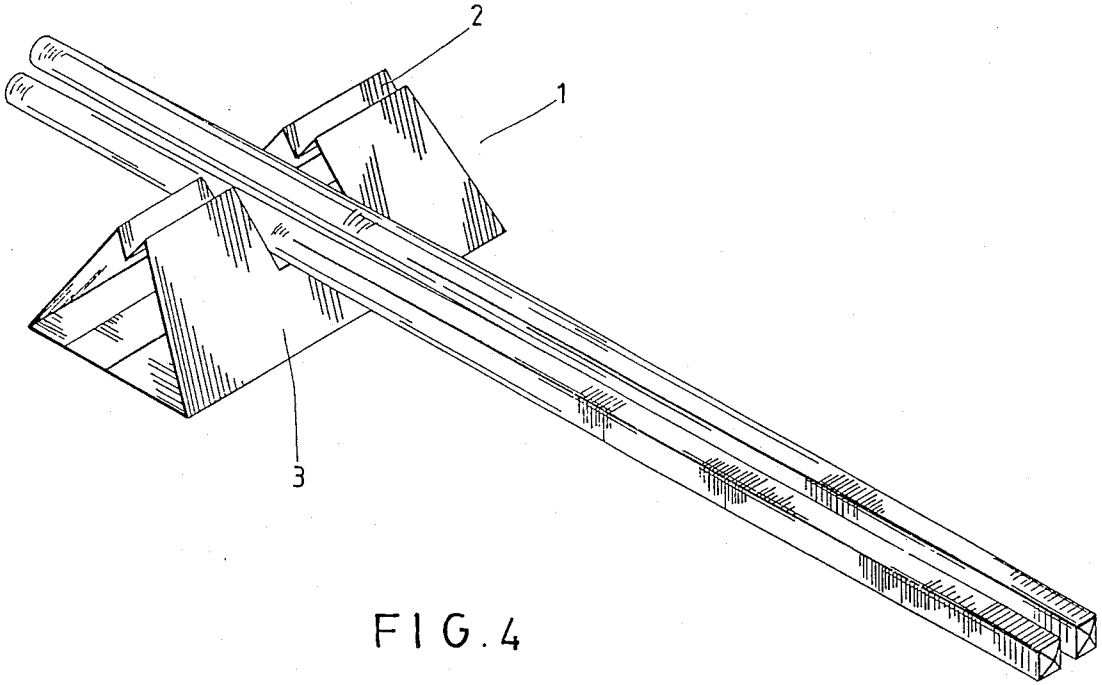
FIG. 4 shows how the chopstick seat of the present invention is used.
Figure 5:
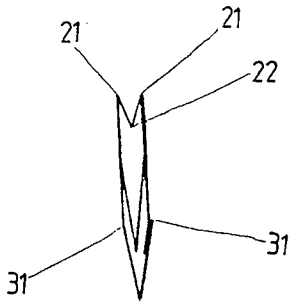
FIG. 5 is an elevational view of the chopstick seat which is collapsed when not in used.

Referring to the drawings, a chopstick seat according to the present invention is shown, having a one piece folded member 1 which is made of a paper material or the like. The folded member includes a portion formed into a V-shaped concave top portion 2 which has two longitudinal top edge folds 21 and a longitudinal bottom edge fold 22 between said top edge folds 21, two diverging side walls 3 extending downward from the longitudinal top edge folds 21 and having two longitudinal bottom edge folds 31, and two horizontal base portions 4 and 5 extending from the bottom edge folds 31 and overlapping one another. Two spaced apart cuts 6 transverse to the top edge folds 21 are provided in the top wall 2 and extend downward into the side walls 3. The cuts 6 terminate at two points A higher than the horizontal base portions 4 and 5 in each side wall 3 and divide the top wall 2 and the side walls 3 into two spaced apart first portions 7 and a second portion 8 between the first portions. The second portion 8 is further provided with two longitudinal folding lines 9 between the terminating points A and is folded therealong inwardly until both the top edge folds 21 approach one another and until the V-shaped concave top portion is folded and extends downward. The folded second portion 8 forms an indented seat face between the first portions 7. The folding lines 9 are horizontal so that the indented seat face is flat and horizontal.

With the invention thus explained, it is apparent that various modifications and variation can be made without departing the scope of the invention. It is therefore intended that the invention be limited as indicated in the appended claims.

What I claim is:

1. A chopstick seat comprising:

a one piece foldable member folded to form a seat body including a portion folded to form a V-shaped concave top portion which has two longitudinal top edge folds and a longitudinal bottom edge fold, two diverging side walls extending downward from said longitudinal top edge folds and having two longitudinal bottom edge folds, and two horizontal base portions respectively extending from said bottom edges folds of said side walls and overlapping one another, and two spaced apart cut lines which are transverse to said longitudinal top edge folds provided in said top wall and which extend downward into said side walls, said cut lines terminating in each of said side walls at two points higher than the level of said base portions in each of said side walls and dividing said top wall and said side walls into two spaced apart first portions and a second portion between said first portions, said second portion being further provided with two longitudinal folding lines each extending between said terminating points in each of said side walls and being folded therealong until said top edge folds of said side walls approach one another and until said V-shaped concave top portion is collapsed and extends downward, said folded second portion forming an indented seat face between said first portions.

2. A chopstick seat as claimed in claim 1, wherein said terminating points are substantially at the same height from said horizontal base portions.

* * * * *